United States Patent [19]

Kassarich

[11] Patent Number: 5,073,139

[45] Date of Patent: Dec. 17, 1991

[54] NOISE-MAKER

[76] Inventor: Jacob Kassarich, 63 Academy Rd., Bala-Cynwyd, Pa. 19004

[21] Appl. No.: 538,078

[22] Filed: Jun. 14, 1990

[51] Int. Cl.[5] ..... A63H 5/00

[52] U.S. Cl. ..... 446/242

[58] Field of Search ..... 446/242, 265, 266, 397, 446/485

[56] References Cited

U.S. PATENT DOCUMENTS

| | | | |
|---|---|---|---|
| 1,693,140 | 11/1928 | Dietze, Jr. | 446/420 |
| 3,037,322 | 6/1962 | Baumgartner, Jr. | 446/242 |
| 3,924,114 | 12/1975 | Sanchez | 446/242 |
| 4,568,303 | 2/1986 | Grown | 446/242 |

*Primary Examiner*—Mickey Yu

[57] ABSTRACT

This invention provides a hand-held electronic noise-maker which emits blinking and/or non-blinking light and makes noise when a centrifugal force activated lever switch is closed by rotation of the spinning container.

3 Claims, 3 Drawing Sheets

NOISE-MAKER

BACKGROUND OF INVENTION

Children and adults, from time immemorial have enjoyed and actively employed noisemakers in various pursuits during Halloween, Birthday parties, New Year's Eve parties, Anniversaries and in support of other special events in which raucous noise is fitting, appropriate and desired.

Normally loud noises and in fact noises of any amplitude are absolutely forbidden in a synagogue. However, there is a singular, extraordinary occasion during which noise is permitted and, in fact, needed as an integral part of the religious ceremony conducted within the Jewish faith. That occasion is during the reading of the Book of Ester.

The book of Ester relates the story of a tyrant named Hyman. He tried to use his official power to destroy or annihilate the Jews, kill the king and usurp the throne. His plot was discovered by Queen Ester. She informed her husband the king. Hyman was hung and the Jews were saved.

When the Book of Ester is read in a synagogue, Hyman's name is drowned out by noise-makers to make it inaudible. For hundreds of years these noise-makers consisted of a wooden device with a sprocket and bar to produce noise when rotated. In current times, these noise-makers are made of sheet metal with a plastic sprocket.

BRIEF DESCRIPTION OF THE INVENTION

This invention is an electronic high technologic version of these noise-makers. It consists of a translucent container to display the electronics, several light-emitting diodes (blinking and non-blinking) for dramatic effects and a noise producing buzzer which replaces the noise of the sprocket and bar of the conventional noise-makers. The buzzer is actuated by rotating the device in a manner similar to conventional noise-makers to keep its historical significance. Rotation of the device produces a piercing sound when the buzzer is activated. Activation of the buzzer occurs when a lever switch is depressed by a weight which is accelerated by centrifugal force. This can be expressed by the formula:

$$C = Mw^2R$$

where

C = centrifugal force

M = mass w = angular velocity

R = radius

As the speed of rotation or angular velocity is increased so is the centrifugal force as seen in the above equation. The buzzer is engaged on rotation to produce its noise and shuts itself off when rotation ceases.

Although this is primarily designed as a religious article, it has many other applications. It can be used the Fourth of July, New Year's Eve or any other similar occasion where noises are required. More light-emitting diodes can be added and/or the buzzer can be replaced with an integrated circuit chip to produce sound or music. This circuit is hard wired but the entire electronics (including the light-emitting diodes and buzzer activating switch) could be on a printed circuit board. The lever switch could be responsive to smaller operational forces to open and close the circuit and a small weight could be attached to the end of the lever to activate it.

DETAILED DESCRIPTION OF THE INVENTION

The invention can best be understood by reference to the accompanying drawings.

Figure 1:
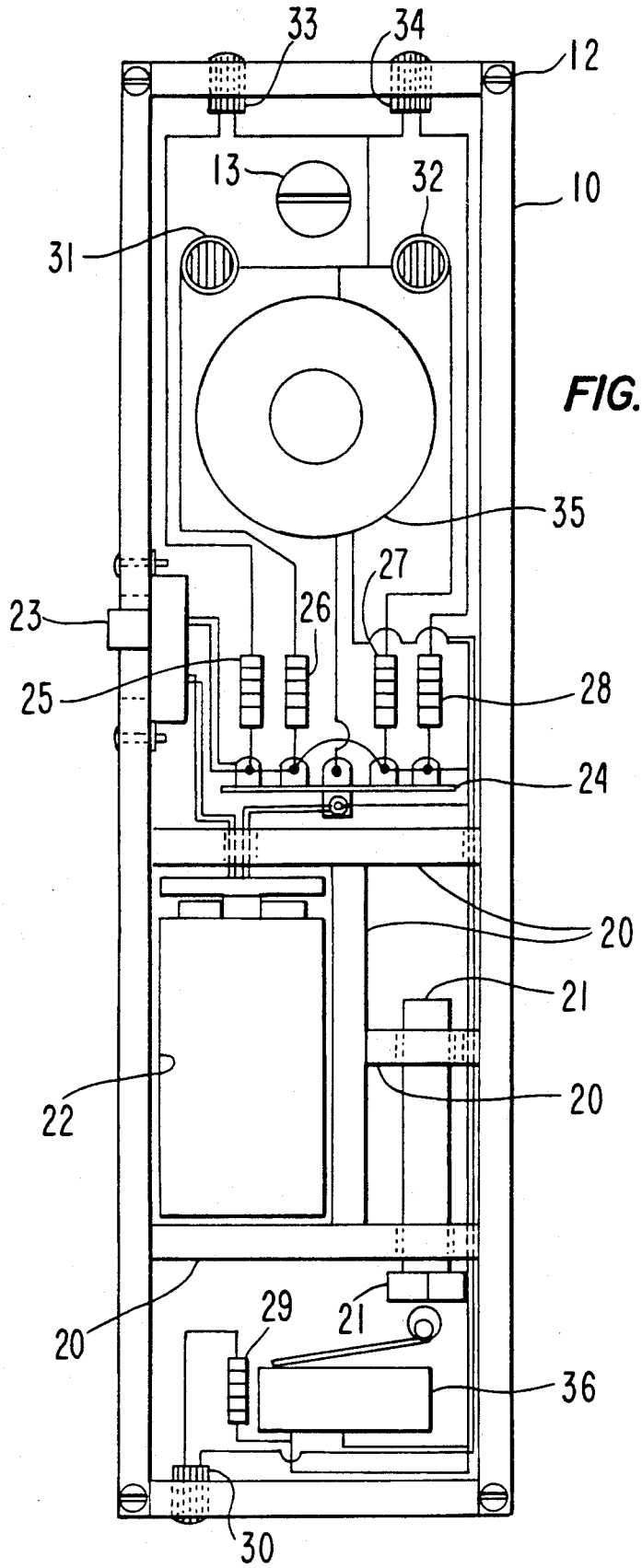

FIG. 1 presents an actual size drawing of the top view of the invention.

Figure 2:
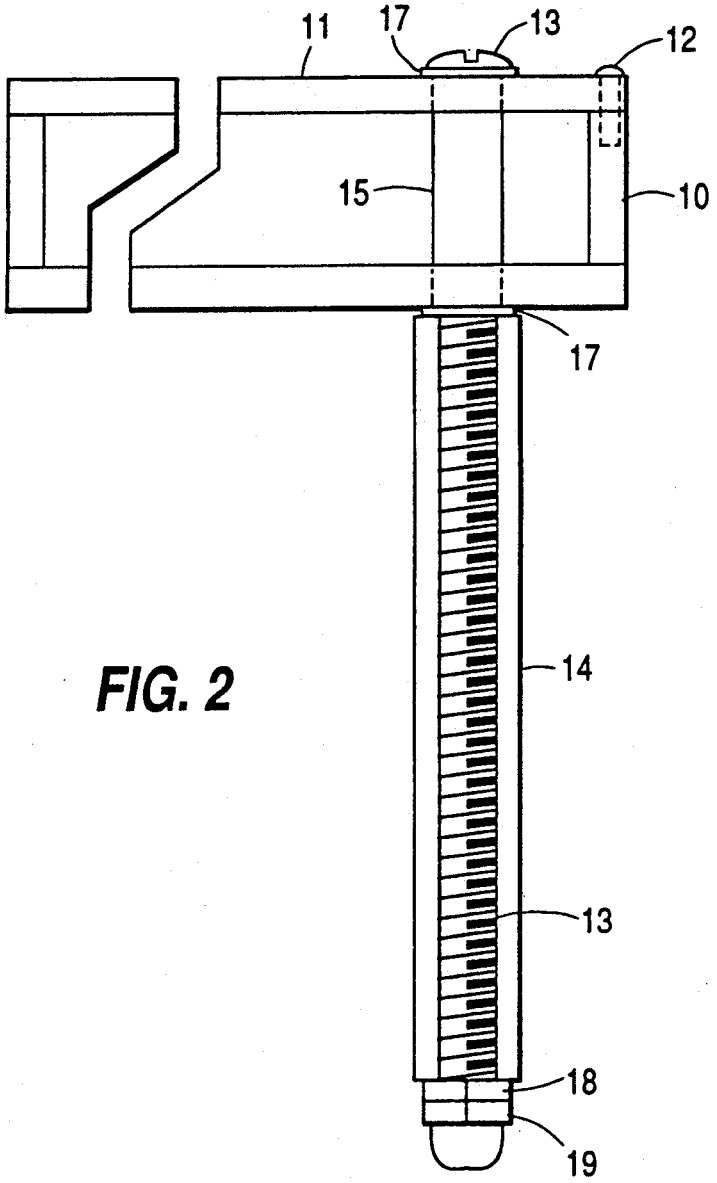

FIG. 2 presents an actual size side view showing the handle assembly.

Figure 3:
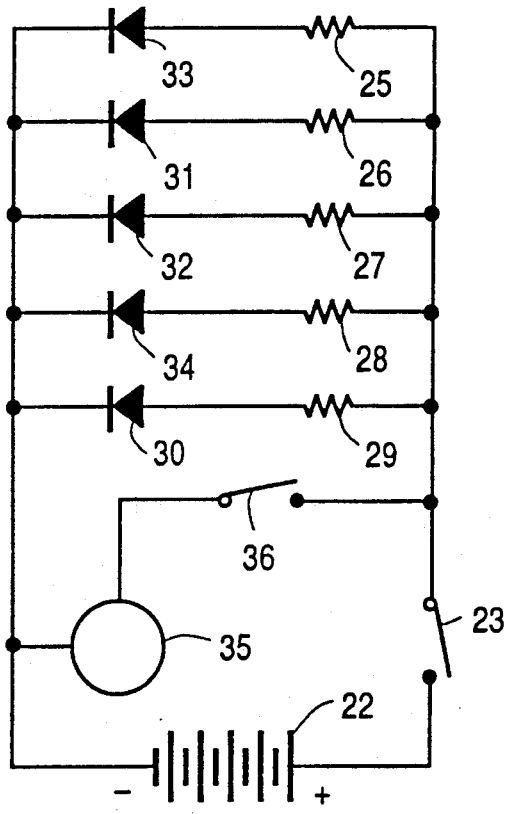

FIG. 3 presents the circuitry applicable to the operation of the invention.

In operation, FIG. 1 presents a Lucite container 10 housing Lucite partition plates 20 forming a compartment for the battery 22 and an apparatus for the weight ($\frac{1}{4}$"×$1\frac{1}{2}$" bolt) 21 to slide in and out. This bolt is devoid of threads for free movement to activate lever switch 36. This is the switch that is operated by centrifugal force.

The main power switch 23 suppplies power to voltage dropping resistors 25, 26, 27 and 28 mounted on terminal strip 24 and to voltage dropping resistor 29. The proper operating voltage is available to the blinking light-emitting diode 30, the light-emitting diode lamps 31 and 32 and to the T-$1\frac{3}{4}$ light-emitting diodes 33 and 34. The buzzer 35 receives its voltage from the circuit completed by lever switch 36.

In FIG. 2 the details of the Lucite handle 14 shows a $\frac{1}{4}$×20 six inch bolt 13 with $\frac{3}{8}$" stainless steel bushing 15 and nylon washers 17. The bolt 13 goes through a 5/16 inch hole in a $\frac{5}{8}$ inch Lucite rod to form the handle 14. This is attached by a $\frac{1}{4}$×20 nut 18 and acorn nut 19. Also shown is the Lucite cover plate 11 and 6/32 machine screws 12 to attach this plate to the body of the invention 10.

In FIG. 3 a 9 volt battery 22 supplies all power. The main power switch 23 is a subminiature slide switch. A subminiature lever switch 36 supplies 9 volts to buzzer 35 which requires 52 miliamps and gives a sound level of 70 decibels. Resistor 29 is 110 ohms $\frac{1}{2}$ watt to supply 3 volts to blinking light-emitting diode 30 which is a T-$1\frac{3}{4}$ diode containing an M-O-S integrated circuit driver giving a blinking rate of two cycles per second. Resistors 25, 26, 27 and 28 are 340 ohms $\frac{1}{2}$ watt and supply 2 volts to subminiature light-emitting diodes 33 and 34.

I claim:

1. A rotatable, electronic noise-maker comprising a container housing light-emitting means, noise producing means actuated by a centrifugal force switch and electronic circuitry, said container being rotatably attached to an approximately perpendicular handle, and comprising translucent, substantially rectangular front and rear wall members attached to substantially rectangular top and bottom wall members and two end wall members, said container internally compartmentalized with translucent partition plates separating the centrifugal force actuated switch from the electronic circuitry and a power source means from both the electronic circuitry and said centrifugal force activated switch, said partition plates providing at least one aperture for passage of circuitry between said compartments.

2. A noise-maker of claim 1 in which said container is attached to a cylindrical handle by bolt means passing through the handle and securing said container through its bottom wall at a point near the end sufficiently distant from the centrifugal switch to provide the force needed to close said switch.

3. The noise-maker of claim 1 in which said light-emitting means are blinking and non-blinking diodes.

* * * * *